United States Patent [19]

Nishimoto et al.

[11] Patent Number: 5,009,726

[45] Date of Patent: Apr. 23, 1991

[54] METHOD OF MAKING NON-ORIENTED SILICON STEEL SHEETS HAVING EXCELLENT MAGNETIC PROPERTIES

[75] Inventors: Akihiko Nishimoto; Yoshihiro Hosoya; Kunikazu Tomita; Toshiaki Urabe; Masaharu Jitsukawa, all of Tokyo, Japan

[73] Assignee: NKK Corporation, Tokyo, Japan

[21] Appl. No.: 427,128

[22] PCT Filed: Mar. 3, 1989

[86] PCT No.: PCT/JP89/00232

§ 371 Date: Oct. 12, 1989

§ 102(e) Date: Oct. 12, 1989

[87] PCT Pub. No.: WO89/08151

PCT Pub. Date: Sep. 8, 1989

[30] Foreign Application Priority Data

Mar. 4, 1988 [JP] Japan ..... 63-49576

[51] Int. Cl.[5] ..... H01F 1/047

[52] U.S. Cl. ..... 148/111; 148/3; 148/112

[58] Field of Search ..... 148/111, 3, 110

[56] References Cited

U.S. PATENT DOCUMENTS

| | | | |
|---|---|---|---|
| 4,066,479 | 1/1978 | Shimoyama et al. | 148/111 |
| 4,204,890 | 5/1980 | Irie et al. | 148/111 |

FOREIGN PATENT DOCUMENTS

| | | | |
|---|---|---|---|
| 2332 | 1/1978 | Japan | 148/111 |
| 76422 | 6/1979 | Japan . | |
| 123825 | 7/1983 | Japan | 148/111 |
| 138014 | 7/1985 | Japan | 148/111 |
| 127817 | 6/1986 | Japan . | |
| 278227 | 12/1987 | Japan . | |

*Primary Examiner*—Prince E. Willis
*Assistant Examiner*—R. D. Flatter
*Attorney, Agent, or Firm*—Henry C. Nields

[57] ABSTRACT

The present invention is to produce non-oriented silicon steel sheets having excellent magnetic properties in dependence upon a hot direct rolling, wherein the slab is directly sent to the direct rolling without maintaining the heat and soaking, whereby others than AlN precipitated during hot rolling check the precipitation of AlN, and a delay time is taken between the roughing and the finish rolling so that precipitating nuclei of AlN are introduced into the steel, and uniform and coarse AlN precipitation is formed by a subsequent annealing treatment, thereby to enable to provide uniform and satisfied ferrite grain growth at the recrystallization annealing.

3 Claims, 3 Drawing Sheets

METHOD OF MAKING NON-ORIENTED SILICON STEEL SHEETS HAVING EXCELLENT MAGNETIC PROPERTIES

TECHNICAL FIELD

This invention relates to a method of making non-oriented silicon steel sheets having excellent magnetic properties.

BACKGROUND OF THE INVENTION

As important factors of governing magnetic properties of electrical steel sheets, sizes and dispersing conditions of AlN and MnS precipitates in steels are taken up. This is why these precipitates themselves become to obstacles to movements of magnetic domain walls and deteriorate not only the magnetic flux densities under a low magnetic field and the characteristic of iron loss, and in addition they hinder grain growth during recrystallization annealing, and immature grain growth thereby of ferrite grains give bad influences to developments of recrystallization texture preferable to the magnetic properties.

It is known that coarser precipitates are preferable for the movements of the magnetic domain walls during magnetization. Based on such background, there has been disclosed prior art trying to provide the precipitations and coarsenings of AlN or MnS before the recrystallization annealing in the processes of making the electrical steel sheets. For example, Japanese Patent Laid-Open Specification 38814/74 checks re-solution of the coarse AlN during a slab soaking by lowering the heating temperature thereof; Japanese Patent Laid-Open Specification 22,931/81 lowers amounts of S and O accompanying growthes of fine non-metallic inclusions; Japanese Patent Laid-Open Specification 8,409/80 control formation of sulphides by addition of Ca or REM; Same 108,318/77, 41,219/79 and 123,825/83 coasen AlN by brief soaking of the slab before the hot rolling; and Same 76,422/79 utilizes self-annealing effect by coiling at super high temperature after hot rolling for coarsing AlN and accelerating growth of ferrite grain.

From a viewpoint of saving the energy in the process, it is advantageous to carry out a hot direct rolling from the continuous casting of slab when performing the hot rolling. However, if depending upon this process, a problem occurs that the coarse precipitations of AlN and MnS are insufficient, and for solving the problem, the slab is subjected to the brief soaking before the hot rolling.

However, although the soaking time is short, such a process which once transfers the slab into the heating and soaking furnaces, could not enjoy merits of saving energy brought about by the hot direct rolling, and further for providing precipitation of AlN, if the soaking time is short, the precipitation will be non-uniform at the inside and outside of the slab.

DISCLOSURE OF THE INVENTION

In view of these problems of the prior art, in the invention the slab is directly sent to the hot rolling without the brief soaking, whereby others than AlN precipitated during hot rolling check the precipitation of AlN, and a delay time is taken between the roughing and the finish rolling so that precipitating nuclei of AlN are introduced into the steel, and uniform and coarse AlN precipitation is formed by a subsequent annealing treatment, thereby to enable to provide uniform and satisfied ferrite grain growth at the recrystallization annealing.

That is, the invention comprises roughing a slab immediately after continuously casting thereof to thickness of more than 20 mm at reduction rate of more than 10% without the brief soaking at a specified temperature range, said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %, balance being Fe and inavoidable impurities; having a time interval of more than 40 sec at temperature range where the surface temperature of the roughed bar is more than 900° C. till a following finish rolling; performing a finish rolling and coiling at temperature of not more than 650° C.; annealing the hot rolled band by soaking it at the temperature of 800° to 950° C. for a period of time satisfying $$\exp(-0.022T + 21.6) \leqq t \leqq \exp(-0.030T\ 31.0)$$

herein,

T: soaking temperature (° C.)

t: soaking time (min);

carrying out cold rollings of once or more than twice interposing an intermediate annealing and a final continuous annealing at range of temperature between 850° and 1100° C.

DETAILED DESCRIPTION OF THE INVENTION

In the invention, the roughing is performed on the slab immediately after continuously casting thereof to the thickness of more than 20 mm at the reduction rate of more than 10%, without the brief soaking at specified temperature range, said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %, balance being Fe and inavoidable impurities, and subsequently the finish rolling is performed after having the specific time interval (called as "waiting time" hereinafter).

The precipitating nuclei of AlN are introduced into the steel during the waiting time so as to rapidly provide the uniform and coarse AlN precipitation. In the above roughing, a strain is introduced into the steel and a solidified structure is destructed, thereby to accelerate the introduction of the uniform precipitating nuclei of AlN in the following short waiting time, for which the reduction rate of more than 10%, preferably more than 20% is secured.

If the roughed bar has a too thin gauge, the cooling rapidly advances with an insufficient nucleation of AlN during the waiting period and it is difficult to not only provide the suitable precipitation but also secure the temperature of the finish rolling. Therefore, the thickness of the roughed bar should be 20mm in the lower limit, preferably 30mm.

Figure 1:
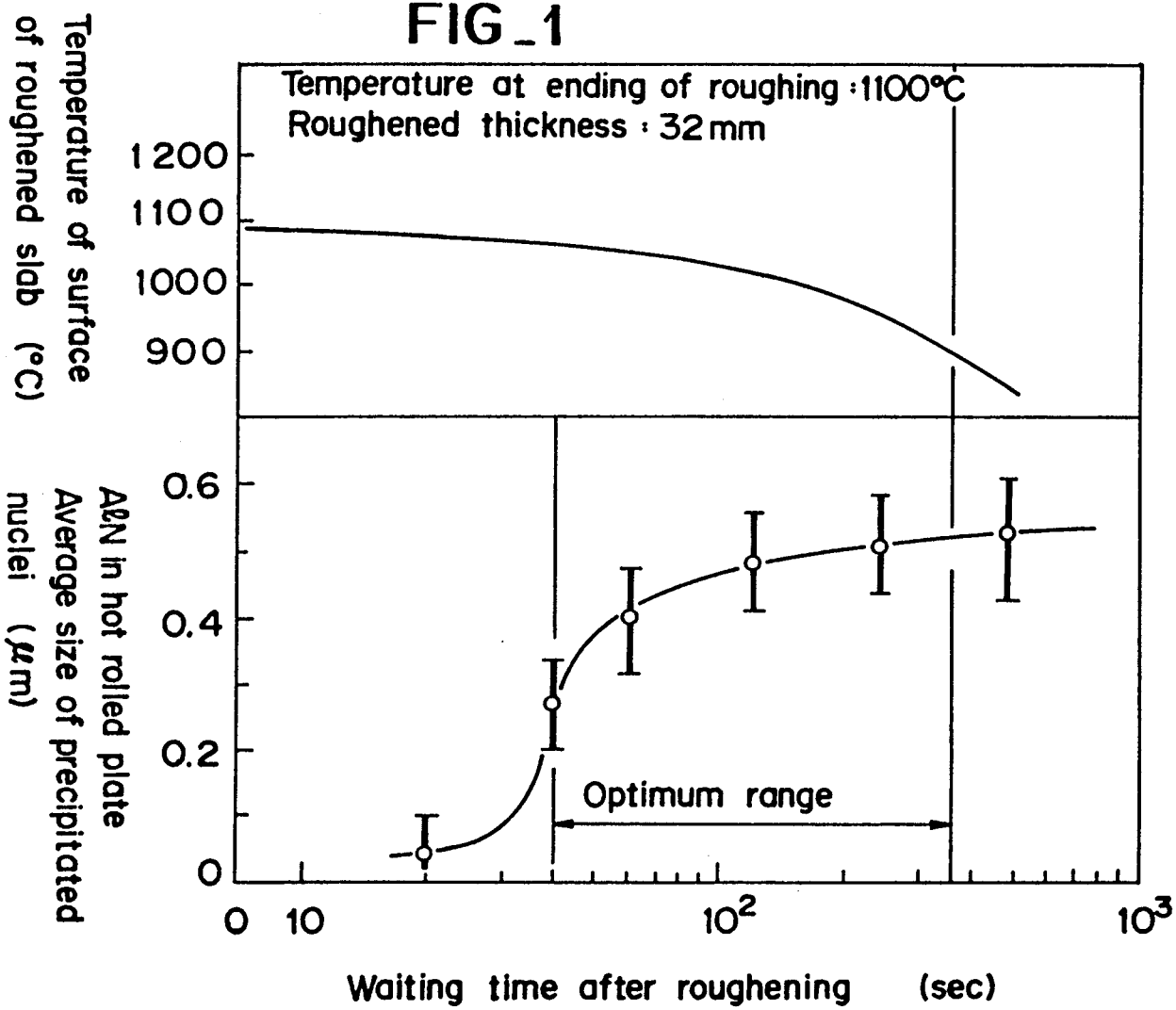
FIG. 1 shows influences of a waiting time after a roughing on the sizes of precipitating nuclei of AlN during hot rolling, and changings of the surface temperature of the roughed bar as time passes.

During the waiting till the final rolling after the roughing the surface temperature of the roughed bar is kept more than 900° C. for the purpose of securing the temperature of the final rolling and usefully accelerating the nucleation of the precipitating nuclei of AlN at its precipitating noses. The waiting time is determined more than 40 sec. FIG. 1 takes up an example of 3% silicon steel (Steel No.4 of Table 1; Temperature at ending of the roughing: 1100° C.; and Thickness of roughed bar: 32 mm) and shows the influences of the waiting time (time from ending of the roughing to starting of the finish rolling) after the roughing to sizes of the precipitating nuclei of AlN during hot rolling, and changings of the surface temperature of the roughed bar along with time passing. It is seen that the waiting time of more than 40 sec, preferably 60 sec should be secured. On the other hand, if the waiting time is taken too much, the surface temperature of the roughed bar becomes lower than 900° C. and the finish rolling would be difficult. In the roughed bar of FIG. 1 having the thickness of 32mm and at the ending temperature of the roughing of 1100° C., the surface temperature of the bar goes down to 900° C. during the waiting time of about 2 min or more. Thus, the waiting time should be determined not to lower the starting temperature of the finish rolling down 900° C. in response to the ending temperature of the roughing and the thickness of the roughed bar.

The waiting time herein designates a time until the starting temperature of the finish rolling from the ending of the roughing including the strip's normal running time and a delay time (an intentional waiting time). It will be assumed normally necessary to normally have the delay time for practising the present invention, but if the running time between the rollings satisfies the above waiting time the delay time is not necessary.

Further, it is possible to heat the edges of the roughed bar for compensating temperature thereat in the waiting time, whereby the invention may be effectively practised.

In this invention, the waiting after roughing is to be carried out for introducing the precipitating nuclei of AlN, and the perfect precipitation is accomplished during the annealing of the hot rolled band. Therefore, the coiling temperature is set below 650° C. not to cause non-uniform precipitation of AlN in the whole length of the coil after the finish rolling and not to precipitate AlN at coiling. If scales exist on the surface of the hot rolled band when undertaking the annealing of the hot rolled band, a problem will be deterioration of the magnetic properties caused by nitrization. As a measure to solve such a problem, it is useful to perform de-scaling by pickling before the annealing of the hot rolled band, and also in view of the de-scaling property it is preferable to determine the coiling at the temperature of not more than 650° C.

The hot rolled band is subsequently transferred to the annealing furnace. In the invention, the annealing is performed at temperature of 800° to 950° C. which is around the precipitating noses of AlN in order to coasen the AlN. If the annealing temperature is less than 800° C., AlN is not made fully coarse, while if it exceeds 950° C., the ferrite grains abnormally grow by accelerating the AlN precipitation.

Figure 2:
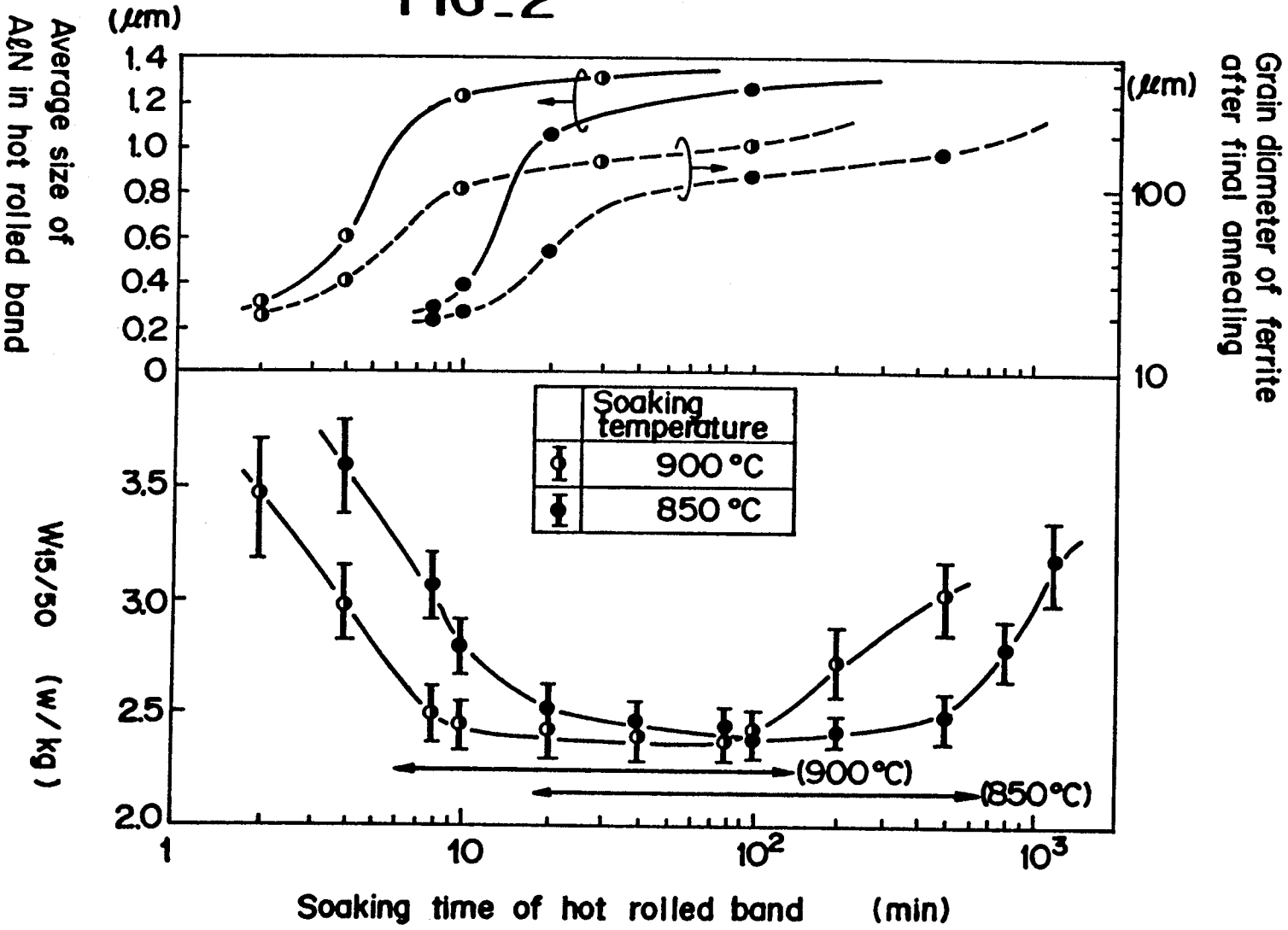
FIG. 2 shows, with respect to 3% Si steel, influences of the soaking time of the hot rolled band on average size of AlN during hot rolling and its magnetic properties.
Figure 3:
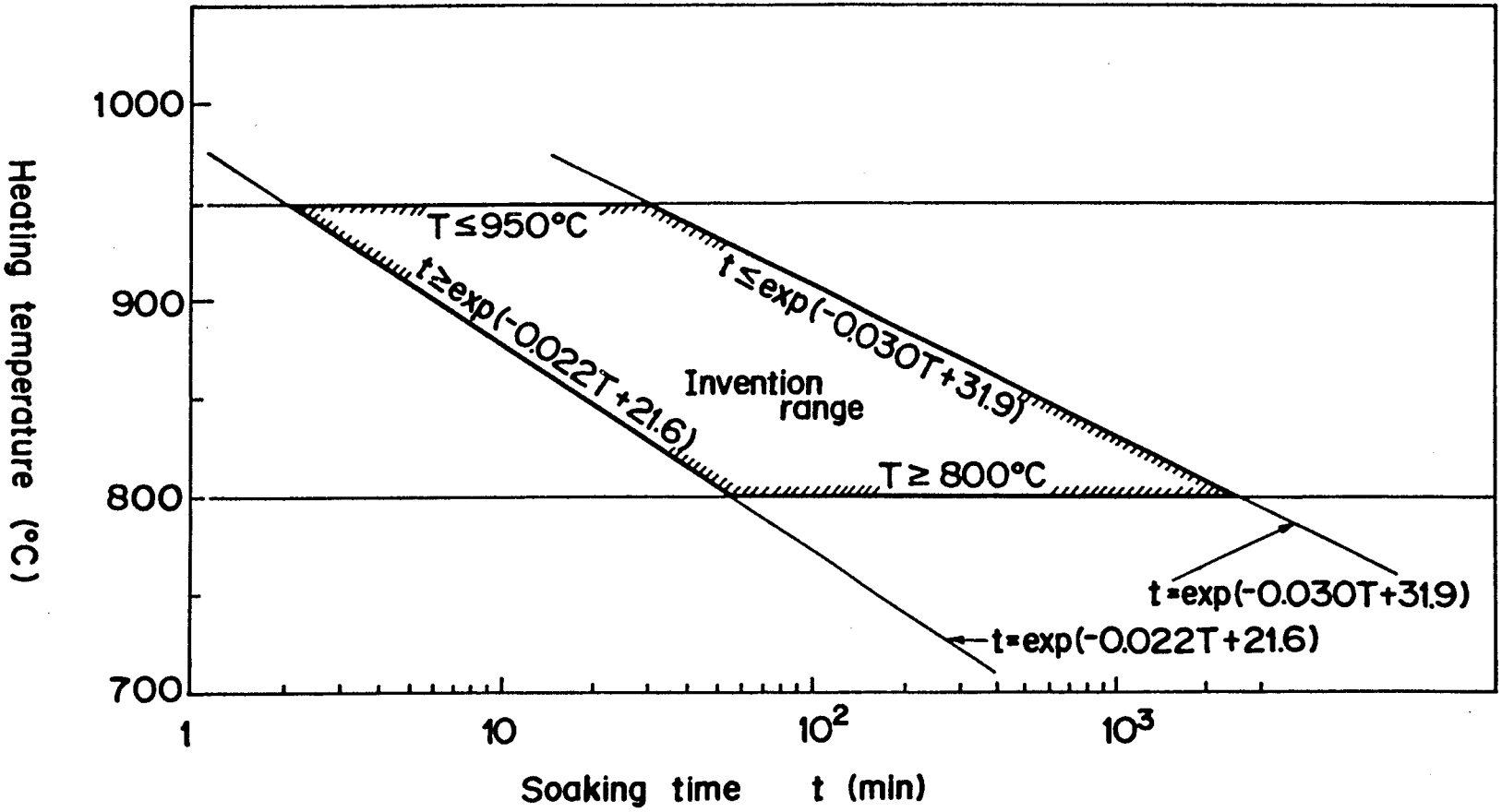
FIG. 3 shows optimum ranges of the soaking temperature and the soaking time during hot band's annealing.

The soaking time t in the annealing furnace is defined in a determined range in relation with the above stated soaking temperature T. FIG. 2 shows, with respect to 3% Si steel, influences of the soaking time of the hot rolled band on average size of AlN during hot rolling and magnetic properties after the final annealing, and it is seen the best range exists in the annealing time of the hot rolled band in response to the soaking temperature. As a result of experiments including also the above case, it is seen that the soaking t (min) should satisfy a following condition in relation with the soaking temperature T (° C.)

$$\exp(-0.022T+21.6) \leqq t \leqq \exp(-0.030T+31.9).$$

That is, for full coarsening of AlN at which the present invention aims, $t \geqq \exp(-0.022T+21.6)$ must be satisfied. If the soaking is carried out more than necessary, the ferrite grains grow abnormally at the temperature of higher than 900° C., and the magnetic properties are deteriorated by formation of nitrided layer at the temperature of below 900° C. If the soaking time t (min) exceeds $\exp(-0.030T+31.9)$, the above mentioned problems occur. Against nitrization, it is useful to preliminarily remove scales by pickling, but as practicable allowance, the above limit is specified.

The steel sheet having passed the hot rolling and the annealing is subjected to the cold rollings of once or more than twice interposing an intermediate annealing, and to the final finish annealing within the range between 850° and 1100° C.

If the soaking temperature of the final annealing is less than 850° C., desired excellent iron loss and the magnetic flux density could not be obtained. But if exceeding 1100° C., such temperatures are not practical to passing of the coil and the cost of the energy. In addition, also in the magnetic properties, the iron loss value increases reversely by the abnormal growth of ferrite grains.

A next reference will be made to reasons for limiting the steel composition.

C is set not more than 0.005 wt % when producing a steel slab so as to secure the ferrite grain growth by lowering C during heat treatment of the hot rolled band and affect coarsening of AlN via decreasing of the solubility limit of AlN accompanied with stabilization of ferrite phases.

Si of less than 1.0 wt % cannot satisfy the low iron loss due to lowering of proper electrical resistance. On the other hand, if it exceeds 4.0 wt %, the cold rolling is difficult by shortening of ductility of the steel.

The upper limit of S is specified for improving the magnetic properties by decreasing an absolute amount of MnS. If S is set below 0.005 wt %, it may be decreased to a level negligible of bad influences of MnS in the direct hot rolling.

Al of less than 0.1 wt % cannot fully coarsen AlN and nor avoid fine precipitation of AlN. If exceeding 2.0 wt %, effects of the magnetic properties are not brought about, and a problem arises about weldablity and brittleness.

Depending upon the present invention, it is possible to secure satisfactorily precipitation and coarsening of AlN in the hot rolling process and the ferrite grasin growth, while performing the hot direct rolling. Therefore, it is possible performing to economically produce the non-oriented electrical steel sheet with excellent magnetic properties, by fully making use of the merits of the direct hot rolling.

EXAMPLE

The continuously cast slabs having the chemical compositions of Table 1 were passed through Hot Rolling—Annealing—Pickling—Cold Rolling—Final Continuous Annealing, and the non-oriented electrical steel sheet. The magnetic properties of the produced electrical steel sheets and the characteristics of the hot rolled plates are shown in Table 2 together with the conditions of the hot rolling, annealing and final annealing.

TABLE 1

| No. | C | Si | Mn | P | S | Sol. Al | (wt %) N |
|---|---|---|---|---|---|---|---|
| 1 | 0.0027 | 1.70 | 0.23 | 0.010 | 0.003 | 0.25 | 0.0015 |
| 2* | 0.0029 | 1.72 | 0.25 | 0.012 | 0.002 | 0.05 | 0.0017 |
| 3* | 0.0031 | 1.71 | 0.20 | 0.008 | 0.008 | 0.31 | 0.0017 |
| 4 | 0.0024 | 3.05 | 0.30 | 0.011 | 0.003 | 0.32 | 0.0013 |

Note
*Comparative Steels

TABLE 2

| No. | Processes | A (%) | B (mm) | C* (sec.) | D (°C.) | E F (°C.) | E G (min) | H I (μm) | H J (μm) | K (°C.) | L (μm) | M $B_3$(T) | M $W_{15/50}$(W/Kg) |
|---|---|---|---|---|---|---|---|---|---|---|---|---|---|
| 1 | Com. pro. | 86 | 30 | 0 | 1080 | 900 | 2 | 0.23 | 5 | 850 | 80 | 1.25 | 4.24 |
| | " | " | " | 10 | 1050 | " | 30 | 0.52 | 4 | " | 85 | 1.29 | 4.01 |
| | Inv. pro. | " | " | 30 | 1020 | " | 30 | 1.25 | 4 | " | 112 | 1.48 | 2.80 |
| | " | " | " | 120 | 920 | 850 | 120 | 1.30 | 2 | " | 110 | 1.46 | 2.92 |
| 2 | Com. pro. | 85 | " | 10 | 1020 | " | " | 0.38 | 3 | " | 72 | 1.30 | 3.53 |
| | Inv. pro. | " | " | 100 | 950 | " | " | 0.61 | 4 | " | 79 | 1.32 | 3.12 |
| 3 | Inv. pro. | 80 | 40 | " | 940 | " | " | 1.20 | 5 | " | 83 | 1.31 | 3.54 |
| 4 | Com. pro. | 80 | " | 10 | 1070 | " | " | 0.62 | 4 | 950 | 95 | 1.25 | 3.26 |
| | " | " | " | 120 | 950 | " | 900 | 1.25 | 32 | " | 150 | 1.21 | 3.73 |
| | Inv. pro. | " | " | " | " | " | 120 | 1.35 | 4 | " | 145 | 1.45 | 2.40 |
| | Com. pro.** | 0 | " | " | 940 | " | 30 | 0.85 | 4 | " | 78 | 1.12 | 2.06 |
| | " | 80 | " | 200 | 870 | " | " | 1.01 | 3 | " | 105 | 1.25 | 2.65 |
| | " | 90 | 15 | 120 | 850 | " | " | 0.87 | 2 | " | 88 | 1.05 | 3.15 |

Note
Inv. pro.: Invention process
Com. pro.: Comparative process
A: Roughing reduction
B: Thickness of roughed bar
C: Delay time
D: Starting temperature of finish rolling
E: Heat treating conditions of hot rolled bands
F: Heating temperature
G: Soaking time
H: Micro substructure of hot rolled structure
I: Sizes of AlN
J: Nitrided layer
K: Annealing temperature
L: Grain diameter after annealing
M: Magnetic properties
*Delay time + 20 sec = Waiting time
**Block casting
Coiling temperature: 550 to 640° C.

INDUSTRIAL APPLICABILITY

The present invention may be applied to production of the non-oriented silicon steel sheets excellent in magnetic properties.

We claim:

1. A method of making non-oriented silicon steel sheets having excellent magnetic properties, comprising roughing a slab so as to form a bar immediately after continuously casting thereof to thickness of more than 20 mm at reduction rate of more than 10% without maintaining the heat or heating at specified temperature range, said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %, balance being Fe and inavoidable impurities; having a time interval of more than 40 sec at temperature range where the surface temperature of the roughed bar is more than 900° C. till a following finish rolling; performing a final rolling and coiling so as to form a coiled plate at temperature of not more than 650° C.; annealing the hot rolled plate by soaking it at the temperature of 800° to 950° C. for a time satisfying $$\exp(-0.022T+21.6) \leqq t \leqq \exp(-0.030T+31.0)$$

herein,

T: soaking temperature (° C.)

t: soaking time (min), carrying out a cold rolling of once or old rollings of more than twice interposing an intermediate annealing and a final continuous annealing at range of temperature between 850° and 1100° C.

2. A method of making non-oriented silicon steel sheets having excellent magnetic properties, comprising roughing a slab so as to form a bar immediately after continuously casting thereof to thickness of more than 20 mm at reduction rate of more than 10% without maintaining the heat or heating at specified temperature range, said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %, balance being Fe and inavoidable impurities; having a time interval of more than 40 sec at temperature range where the surface temperature of the roughed bar is more than 900° C. till a following finish rolling; performing a final rolling and coiling so as to form a coiled plate at temperature of not more than 650° C.; annealing the hot rolled plate by soaking it at the temperature of 800° to 950° C. for a time satisfying $$\exp(-0.022T+21.6) \leqq t \leqq \exp(-0.30T+31.0)$$

herein,

T: soaking temperature (° C.)

T: soaking time (min), carrying out a cold rolling of once or cold rollings of more than twice interposing an intermediate annealing and a final continuous annealing at range of temperature between 850° and 1100° wherein a time interval between the roughing and the finish rolling is more than 60 sec.

3. A method of making non-oriented silicon steel sheets having excellent magnetic properties, comprising roughing a slab so as to form a bar immediately after continuously casting thereof to thickness of more than 20 mm at reduction rate of more than 10% without maintaining the heat or heating at specified temperature range, said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %, balance being Fe and inavoidable impurities; having a time interval of more than 40 sec at temperature range where the surface temperature of the roughed bar is more than 900° C. till a following finish rolling; performing a final rolling and coiling so as to form a coiled plate at temperature of not more than 650° C.; annealing the hot rolled plate by soaking it at the temperature of 800° to 950° C. for a time satisfying $$\exp(-0.022T+21.6) \leqq t \leqq \exp(-0.030T+31.0)$$

herein,

T: soaking temperature (° C.)

t: soaking time (min), carrying out a cold rolling of once or cold rollings of more than twice interposing an intermediate annealing and a final continuous annealing at range of temperature between 850° and 1100° C. wherein edges of the roughed bar are heated for non-rolling period of time between the roughing and the finish rolling.

* * * * *